US007410385B2

(12) United States Patent
Büttner

(10) Patent No.: US 7,410,385 B2
(45) Date of Patent: Aug. 12, 2008

(54) BUSBAR CONNECTION MODULE

(75) Inventor: Alex Büttner, Rödental (DE)

(73) Assignee: Wohner GmbH & Co. KG, Rodental (DE)

( * ) Notice: Subject to any disclaimer, the term of this patent is extended or adjusted under 35 U.S.C. 154(b) by 0 days.

(21) Appl. No.: 11/518,947

(22) Filed: Sep. 12, 2006

(65) Prior Publication Data

US 2007/0212904 A1 Sep. 13, 2007

(30) Foreign Application Priority Data

Sep. 14, 2005 (DE) ..... 10 2005 043 878

(51) Int. Cl.
*H01R 11/20* (2006.01)

(52) U.S. Cl. ..... 439/441; 439/835

(58) Field of Classification Search ..... 439/441, 439/709, 715, 729, 835
See application file for complete search history.

(56) References Cited

U.S. PATENT DOCUMENTS

| | | | | |
|---|---|---|---|---|
| 5,588,881 | A * | 12/1996 | Eggert et al. | 439/709 |
| 5,816,867 | A * | 10/1998 | Davidsz et al. | 439/828 |
| 6,270,384 | B2 * | 8/2001 | Jaag | 439/835 |
| 6,464,545 | B2 * | 10/2002 | Yano | 439/828 |
| 6,488,527 | B2 * | 12/2002 | Yoon | 439/441 |
| 6,893,286 | B2 * | 5/2005 | Drewes et al. | 439/441 |
| 6,911,602 | B2 * | 6/2005 | Conrad | 174/68.2 |
| 2004/0043670 | A1 * | 3/2004 | Feldmeier et al. | 439/709 |
| 2005/0079773 | A1 * | 4/2005 | Prokup et al. | 439/709 |

* cited by examiner

*Primary Examiner*—Hien D. Vu
(74) *Attorney, Agent, or Firm*—Sughrue Mion, PLLC

(57) ABSTRACT

The invention relates to a busbar connection module comprising a housing and a predetermined number of clamping devices arranged in the housing for receiving and fastening exposed line ends, comprising feet projecting on the underside of the clamping devices for fastening to busbars, the clamping devices being arranged in succession in a plane and being constructed without screws.

14 Claims, 8 Drawing Sheets

BUSBAR CONNECTION MODULE

The invention relates to a busbar connection module comprising a housing and a predetermined number of clamping devices arranged in the housing for receiving and fastening electric lines of exposed cable ends according to the preamble of claim 1.

Figure 1:
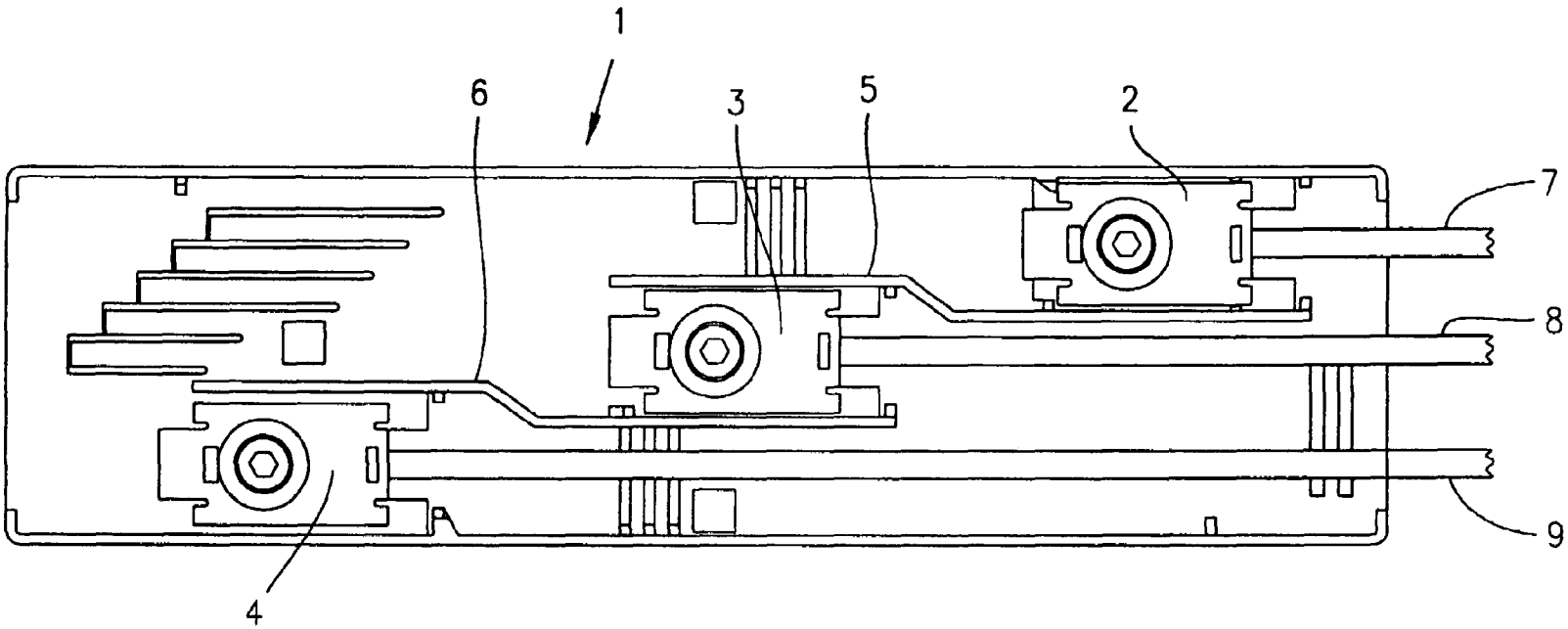

A known busbar connection module which is formed with three poles and consists of a housing is described in FIG. 1, wherein a number of clamping devices matched to the number of poles is provided. FIG. 1 is a plan view of the connection module, which consists of a housing 1 comprising three clamping devices 2, 3, 4 in the embodiment illustrated. Partitions 5, 6 are located between the clamping devices 2, 3, 4. The lines are indicated by 7, 8, 9 in FIG. 1.

Figure 2:
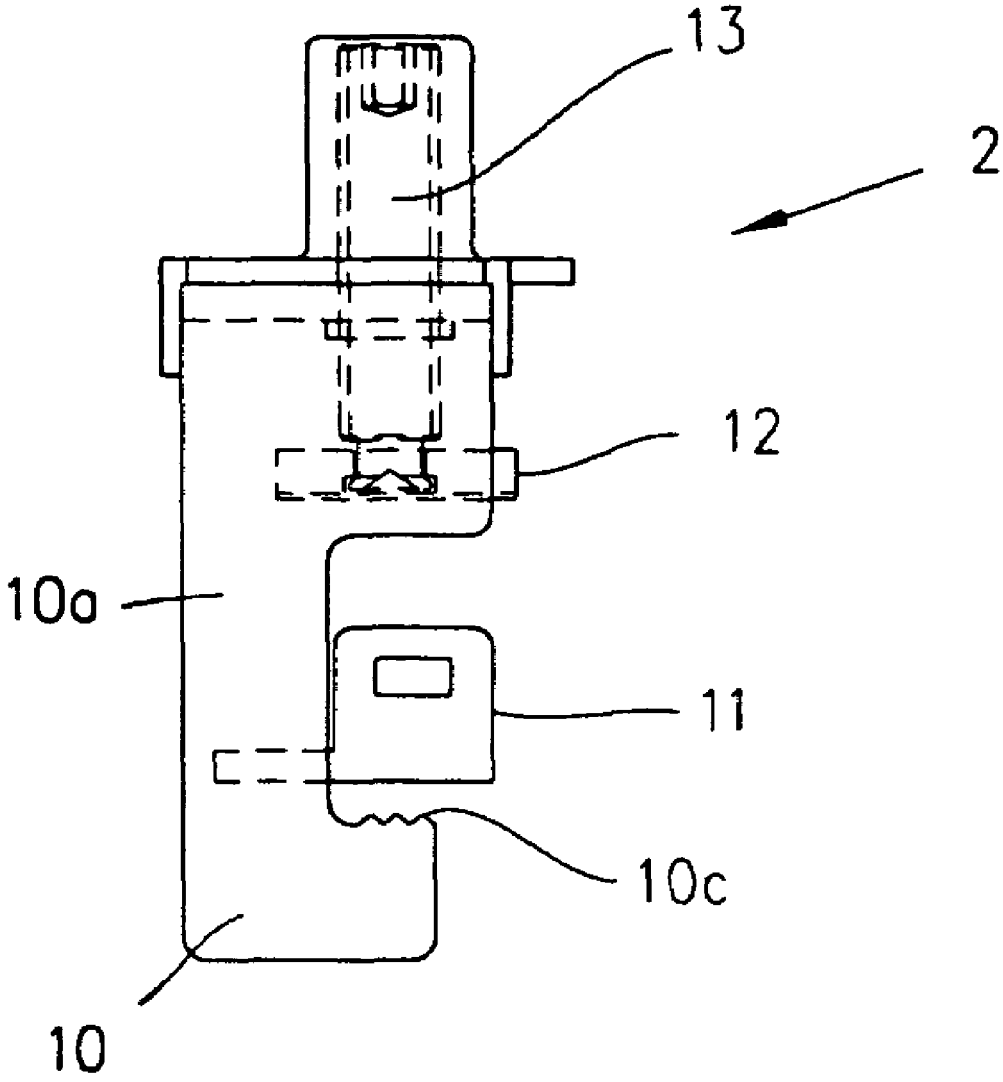

FIG. 2 is a side view of a terminal, as designated by 2 to 4, in conjunction with FIG. 1. The terminal 2 shown in FIG. 2 consists of a metal body 10, which is bent substantially in a U-shape, and two mutually parallel wall portions 10*a*, between which is arranged a contact 11, fixed on the housing side, as well as a mating contact 12 which can be adjusted relative to the metal body 10 and can be adjusted in height relative to the contact 11 by screwing means 13 for the purpose of clamping the exposed end of one of the cables 7 to 9. The end of the metal body 10, which has been bent approximately into an L-shape or is mouth-like, is located at the lower end of the module and is closed laterally by insulating walls, the lower foot portion, provided with teeth 10*c*, of the metal body engaging under one of the busbars, not shown in the figure, in such a way that the mouth-like opening receives a busbar. The metal body 10 is enclosed by insulating feet which are formed on the underside of the housing and surround the body 10 on three sides.

A connection module of this type contains line connection terminals with terminal plates. The conductor connection terminals consist here of metal holding bodies with wire protection clips and clamping screws. The connection module is fastened to the busbars in such a way that the lines or cables, which are generally guided downwards from the housing, do not impede one another. Depending on the cross-section of the lines, the terminals are placed with lateral spacing on the busbars. The connection terminals are commercially available for cable cross-sections of 16 to 300 mm. The busbar connection module has connection plates made of insulating material, such as plastics material, which contain the conductor connection terminals. As described above, the connection terminals or clamping devices are already arranged in an insulating manner relative to one another with corresponding spacing, so the lines are held on the adjacent phase bars in an insulating manner.

A connection module of this type has the disadvantage that, owing to the side-by-side arrangement and the longitudinally offset arrangement of the clamping devices 2, 3, 4, a relatively large amount of space is required, i.e. the connection module has a complex structure overall. The further disadvantage is that the line ends have to be clamped by screwing using a tool to actuate the screw 13 or, if a replacement is required, the screw means 13 have to be released.

The object of the invention is to improve a busbar connection module of the type mentioned at the outset in such a way that a small amount of space is required and the exposed line ends can be installed simply and rapidly.

In accordance with the invention this object is achieved by the features recited in claim 1.

The invention provides a busbar connection module, which is constructed without screws and in which the clamping devices for receiving the exposed line ends are provided in succession in a plane according to the invention. A screwless connection module of this type can be used for cables with a maximum cross-section of 16 $mm^2$.

According to the invention, a connection module of this type may have a width of about 1 cm and is formed with multiple poles. For the purpose of connecting the exposed line ends, it is ensured here in a simple and reliable manner that the exposed line ends are guided from above through a through-opening downwards into the module and are fixed automatically by a spring clamp provided in the module. The exposed line ends are in electrical contact here with the respective spring contacts provided in the module, on the one hand, and a tongue of a retaining spring, on the other hand. When the line ends have to be removed from the module, this can also be effected in a simple and rapid manner, in that the end of a screwdriver or another tool is guided through a separate through-opening to pivot one end of the retaining spring out of the locking position relative to the line end.

In a preferred embodiment of the connection module according to the invention, the walls defining the receiving chambers are moulded or sprayed on a side wall of the housing, while the other side wall can be fixed by latching means to the basic housing. In this manner, the spring contacts and retaining springs can be easily and rapidly fitted for installation in the housing. In the busbar connection module according to the invention, the exit of the line, i.e. the exit of the connection cable, can be upward or downward.

The housing is also provided with a cover which can be opened selectively by upward or downward pivoting. As a result, the cover does not have to be removed during the wiring process. In the open position, the cover is inevitably held and does not hinder installation of the connection cables.

A latching element is also integrated in the housing and ensures a secure fit of the busbar connection module on all common bar widths of a busbar system. A combifoot which points downwards and is moulded onto the housing allows application to busbars with a thickness of 5 or 10 mm, for example.

The busbar connection module according to the invention is provided for lines or cables with a maximum wire thickness of 16 $mm^2$.

Preferred embodiments of the busbar connection module according to the invention will be described hereinafter with the aid of the drawings to describe further features.

Figure 3:
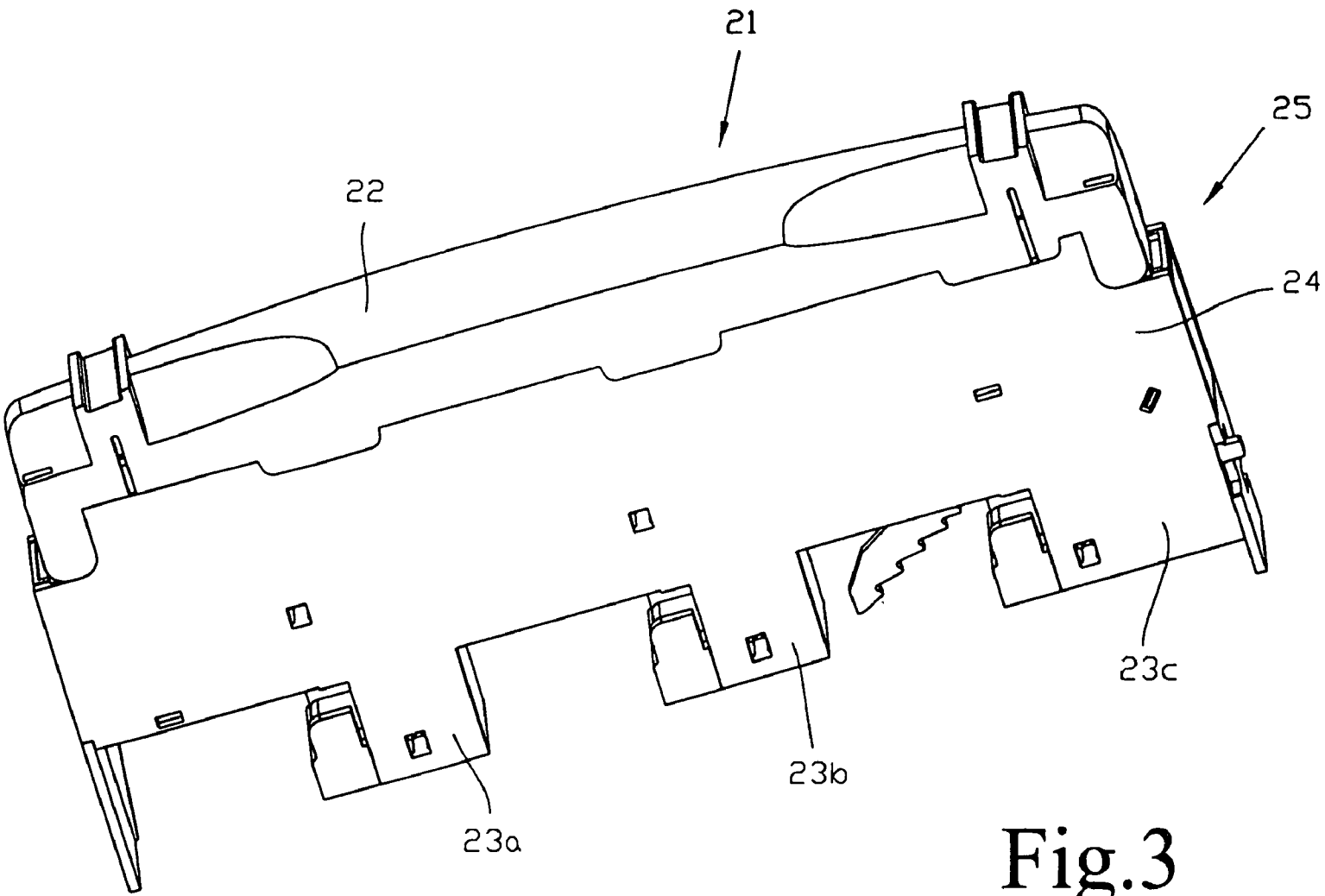
Figure 4A:
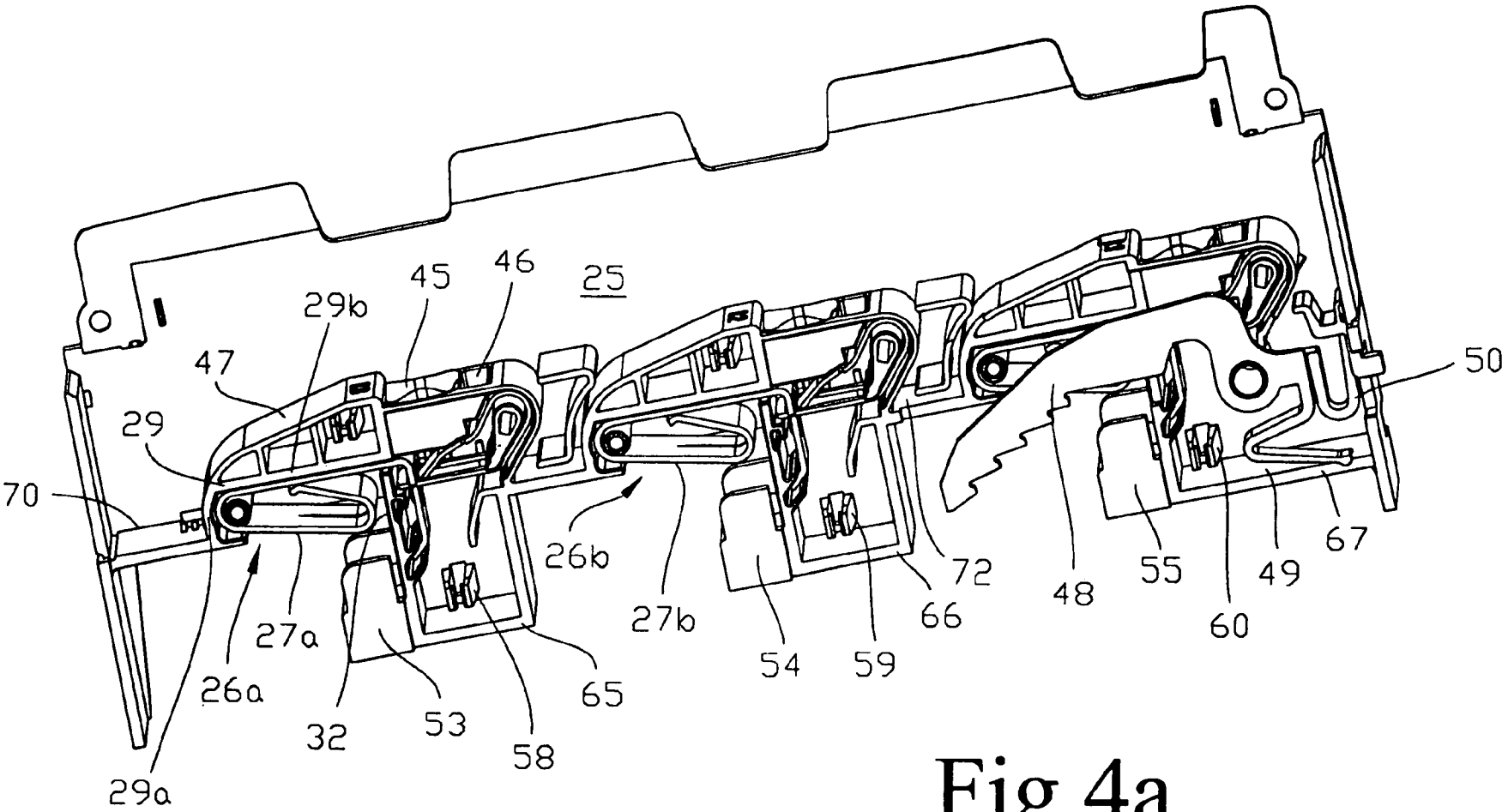
Figure 4B:
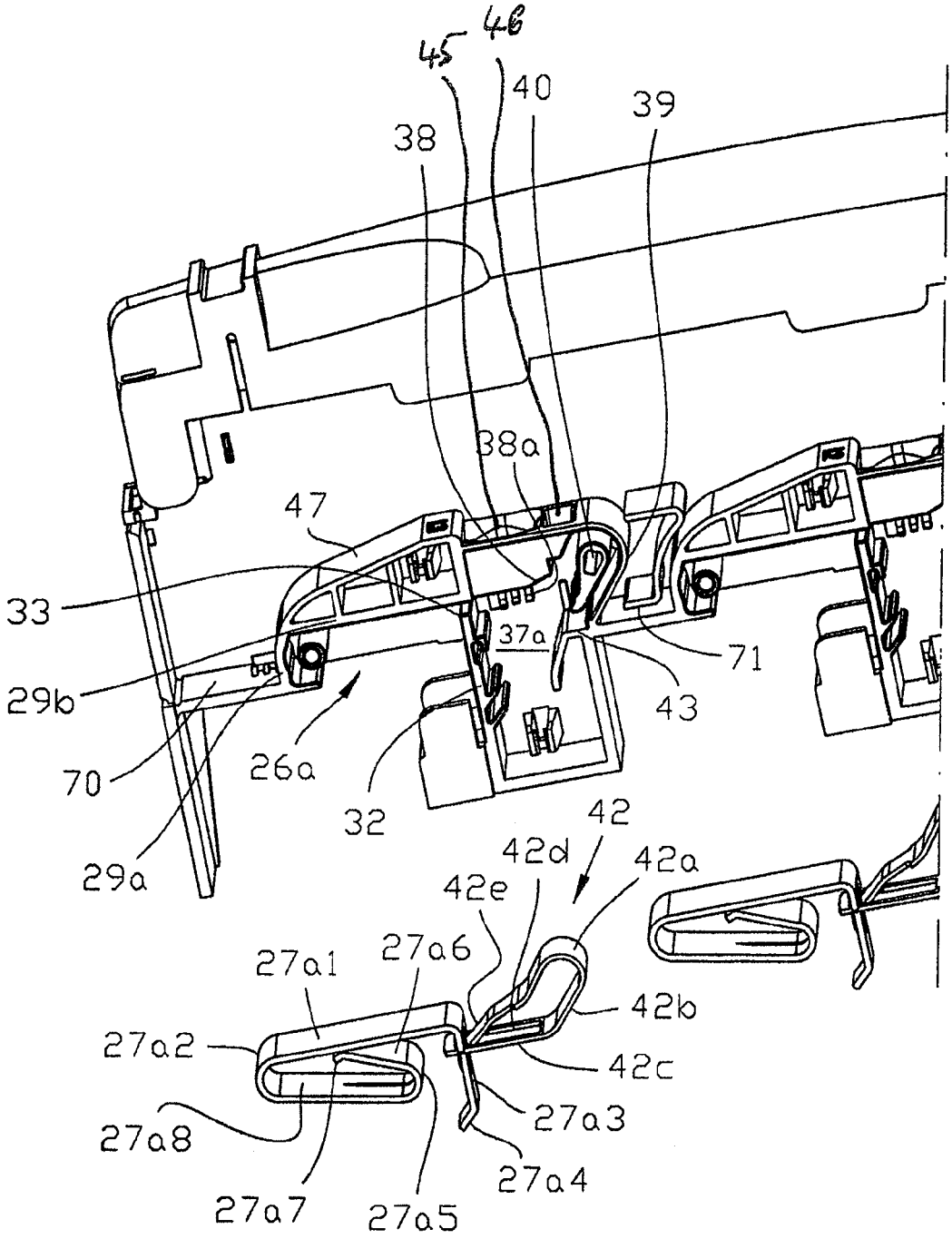
Figure 5:
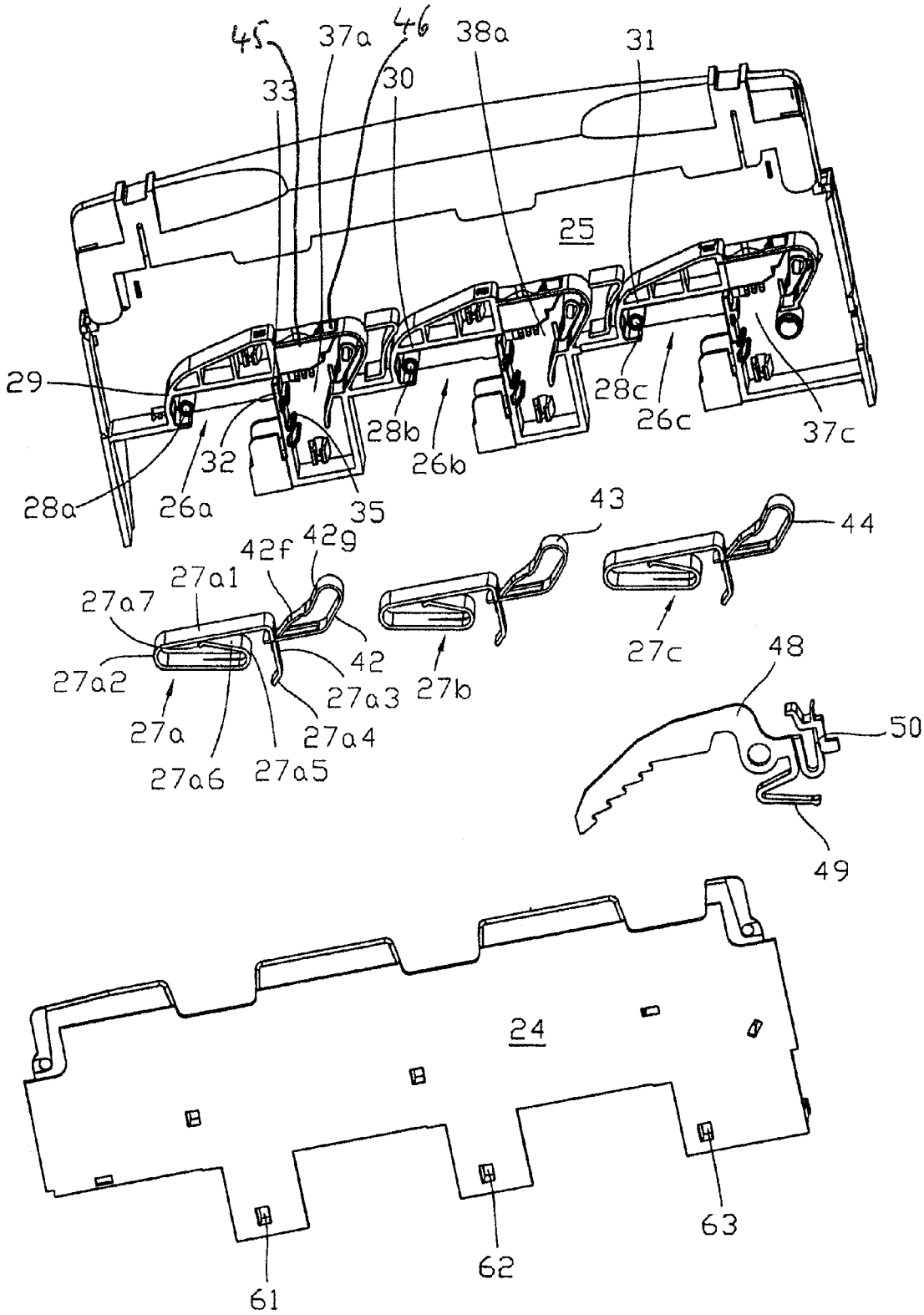
Figure 6A:
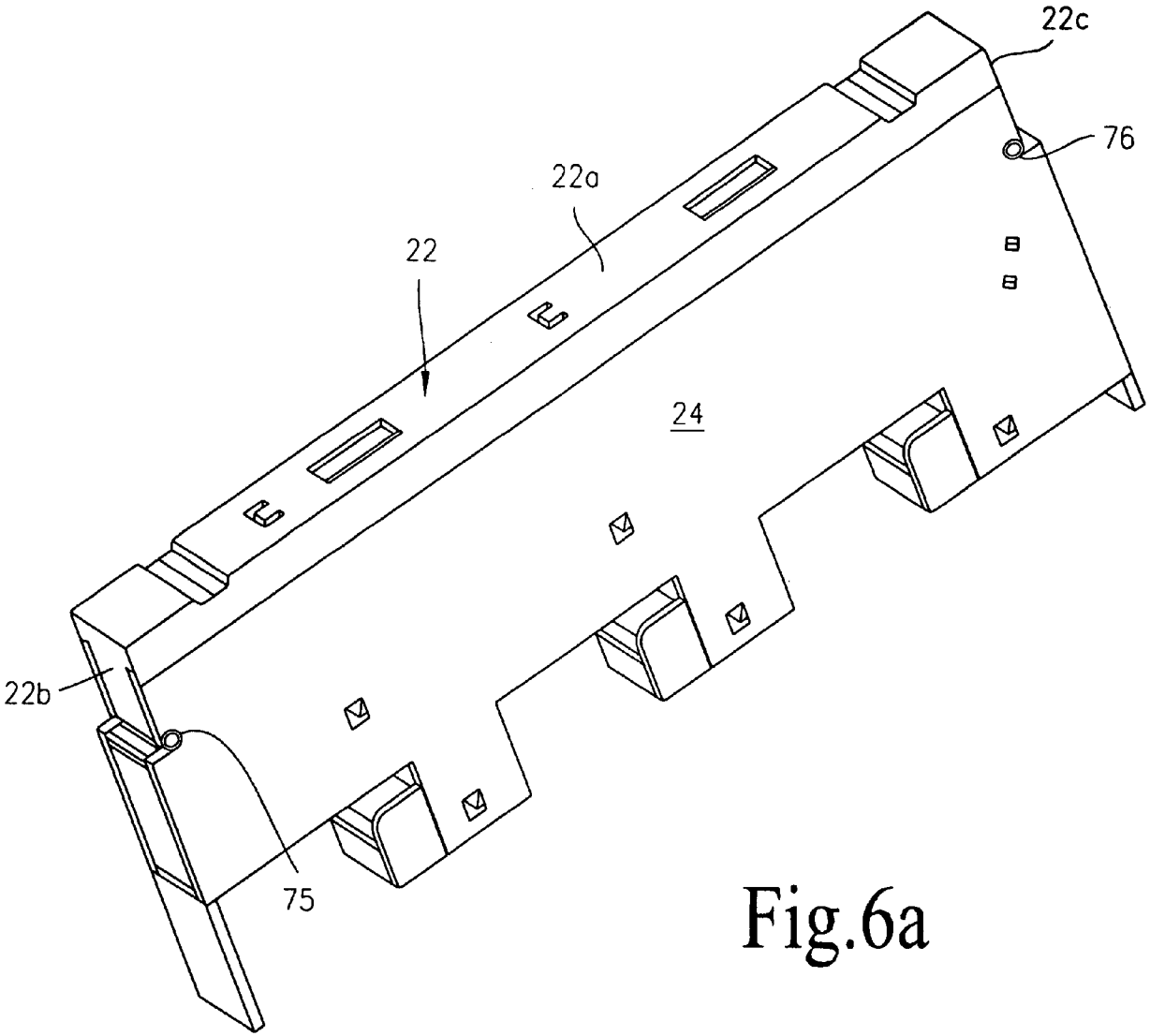
Figure 6B:
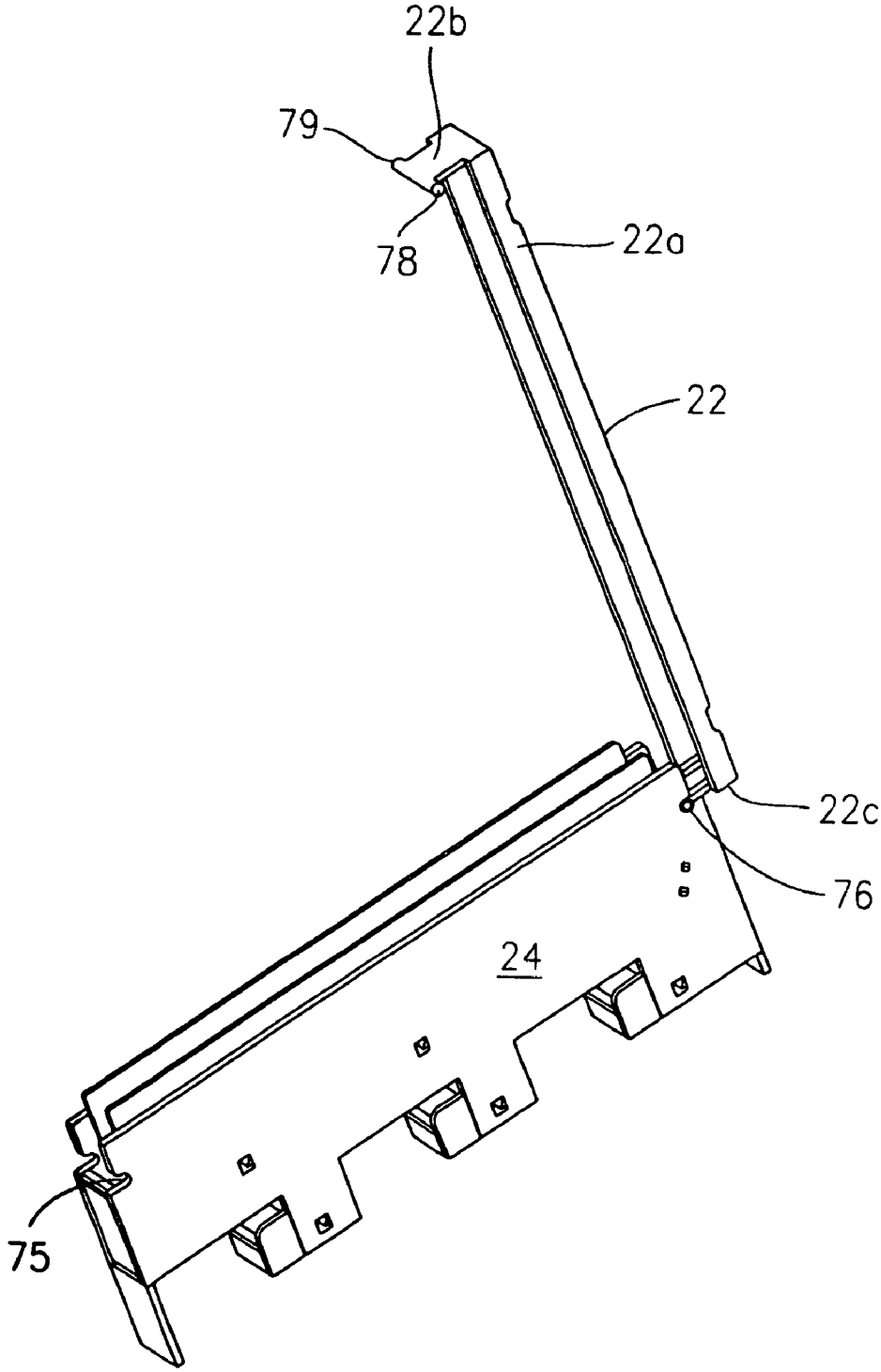

In the drawings:

FIG. 1 is a plan view of a known busbar connection module,

FIG. 2 is the view of a known clamping device for use in the busbar connection module according to FIG. 1, FIG. 3 is a perspective side view of the connection module according to the invention, FIG. 4*a* is a view corresponding to FIG. 3 with the side wall removed for detailed illustration of the receiving chambers and the spring contacts and retaining springs used, FIG. 4*b* is an enlarged partial view from FIG. 4*a*, FIG. 5 is an exploded view of the connection module to illustrate the individual parts, FIG. 6*a* is a schematic perspective view of a connection module for describing the cover and FIG. 6*b* is a view which has been modified relative to FIG. 6*a* to illustrate the mode of operation of the cover.

The busbar connection module according to the invention, hereinafter in brief called a connection module, will be described hereinafter. FIG. 3 is a perspective view of the connection module which consists of a housing 21 and a cover 22. Foot portions 23*a*, 23*b*, 23*c*, leading downwards, are provided on the housing 22. The housing 21 and the foot portions 23*a*, 23*b* consist of a plastics material or an insulating material. The foot portions 23*a* to 23*c* are used for application to busbars, not shown in detail, and contain the electrical contacts of the connection module, as will be further described below.

Referring to FIGS. 3 and 4, the connection module has two mutually parallel side walls 24, 25, the side wall 24 being removed in FIG. 4*a* to illustrate the structure of the connection module. In the embodiment shown, the side wall 24 can be fastened relative to the side wall 25 by latching devices, as will be described.

In accordance with FIG. 4*a*, the connection module contains a respective receiving chamber 26*a*, 26*b*, 26*c* in the case of a configuration of the connection module with three poles for receiving a respective spring contact, which is designated by 27*a*, 27*b*, 27*c* in FIG. 4*a*. Each receiving chamber 26*a*, 26*b*, 26*c* is open downwards, so each spring contact 27*a*, 27*b*, 27*c* can be contacted by the busbars extending in the region of the foot portions 23*a*, 23*b*, 23*c*. Located inside the downwardly open receiving chambers 26*a* to 26*c* is a bearing pin 28*a*, 28*b*, 28*c* which is spaced apart from the adjacent wall 29, 30, 31, so the respective spring contact can be guided round over this bearing pin, as can be seen from FIGS. 4*a* and 5.

The walls 29, 30, 31 defining the receiving chambers 26*a*, 26*b*, 26*c* have a predetermined course, which is described in more detail hereinafter with reference to the wall 29. The wall 29 (FIG. 4*a*) consists of a portion 29*a* which extends substantially vertically, optionally in a slightly curved manner, and a region 29*b* which extends substantially horizontally and substantially preferably straight, the regions 29*a*, 29*b*, which can also be called webs, being used as lateral support walls of the respective spring contacts 27*a*. The substantially horizontally extending region 29*b* is used to support a spring contact portion $\mathbf{27}a_1$, extending parallel thereto, of the spring contact 27*a* (see FIG. 5). A mounting device 28*a* is surrounded by a bent spring contact portion $\mathbf{27}a_2$, which acts as a spring joint. Finally, each receiving chamber 26*a*, 26*b*, 26*c* is limited by a side web or a side wall 32, which extends vertically in the embodiment shown and keeps an opening slot 23 free relative to the wall portion 29*b*, through which slot the extension of the spring contact portion $\mathbf{27}a_1$ passes, as can be seen from FIG. 4*a*, before a substantially vertically downwardly extending spring contact portion $\mathbf{27}a_3$ adjoins the spring contact portion $\mathbf{27}a_1$, the spring contact portion extending downwards to the right of the side wall 32 and substantially parallel thereto, optionally spaced apart therefrom in FIGS. 4*a* and 5.

In the embodiment shown the end of the spring contact portion $\mathbf{27}a_3$ is preferably bent slightly inwards, i.e. in the direction of the bent spring contact portion $\mathbf{27}a_2$ and rests in a bearing slot 35, which is formed in each foot portion 23*a*, 23*b*, 23*c* laterally relative to the wall 32 to allow reliable latching of the portion 27*a* relative to the housing. In this manner each spring contact with its spring contact portion $\mathbf{27}a_3$ is arranged rigidly relative to the housing, i.e. the receiving or holding slot 35 and the spring contact portion $\mathbf{27}a_3$ cannot move away from its position when being slipped onto the respective busbar.

As FIGS. 4 and 5 also show, the spring contact has a further bent section $\mathbf{27}a_5$, adjoined by a bent-back spring tongue $\mathbf{27}a_6$, which rests or can rest with its slightly bent-back spring end $\mathbf{27}a_7$ on the underside of the spring contact portion $\mathbf{27}a_1$ when the connection module is placed or slipped onto the busbar. In non-operative mode, on the other hand, the spring end $\mathbf{27}a_7$ may maintain a slight spacing from the spring contact portion $\mathbf{27}a_1$.

Located between the bend spring contact portion $\mathbf{27}a_2$ and the bent portion $\mathbf{27}a_5$ of the spring contact is a portion, which extends substantially straight and is designated $\mathbf{27}a_8$. The detailed course of a preferably used spring contact 27 will be apparent from the enlarged view of FIG. 4*b*, a gap of a few millimeters being present between the spring contact portion $\mathbf{27}a_1$ and spring end $\mathbf{27}a_7$, when it is not applied to busbars.

Apart from the receiving chamber 26*a*, a second receiving chamber 37*a*, 37*b*, 37*c* is provided in each case, as shown in FIG. 5. This second receiving chamber is described in more detail with reference to the chamber 37*a* and referring to FIG. 4*a*, 4*b* and FIG. 5. The receiving chamber 37*a* is limited on the left-hand side in FIG. 4*b* by the side wall 32 and by webs or walls 38, 39. In particular, reference is made to FIG. 4*b*. Located between the webs or walls 38, 39 is a bearing device 40 in the form of a web or a rib, over which a spring clamp 42 is placed. A leaf or spring clamp 42, 43, 44 is provided for each spring contact. The slightly inclined wall 39, in the embodiment shown, passes into a substantially horizontally extending support wall 43, which projects from the wall 39 over a predetermined distance in the direction of the wall 32. The mounting device 40 maintains a predetermined spacing from the wall 39, so the spring clamp 42 can be inserted on the bearing device 40 and partially resting on the wall 29 into the chamber 37*a*. The spring clamp 42 is correspondingly formed and, according to FIG. 4*b*, has a bent portion 42*a*, which comes to rest substantially on the bearing device 40, furthermore a spring portion 42*b* emanating therefrom and extending substantially straight, a spring clamp portion 42*c* emanating therefrom, which in turn contains a longitudinal slot 42*d* with a width, which corresponds approximately to the tongue 42*e*, receiving the spring clamp end located inside the slot 42*d*. The spring clamp portion 42*c* therefore receives the spring contact portion $\mathbf{27}a_3$, as can be seen, and at the same time the spring clamp end portion 42*e*, the spring clamp end portion 42*e* being pivotal about the bearing device 40 in the clockwise direction in FIG. 4*b* in the manner still to be illustrated, when a line end is inserted.

As will be apparent from FIG. 4*a*, the spring clamp portion 42*c* is approximately horizontal and approximately perpendicular to the spring contact portion 27*a* due to the support wall 43, as the spring clamp portion 42*c* rests on the support wall 43 and is thereby held in this horizontal position. It can also be seen that the spring portion 42*b* rests on the wall 39. Located between the spring clamp end portion 42*e* and the bent portion 42*a* are two further portions 42*f* and 42*g* which are slightly inclined relative to one another and are shown, for the sake of clarity, only in FIG. 5. In order to limit the position of the spring clamps, in particular the position of the portion 42*g*, a projection 38*a* is formed on the limiting wall 38 on the housing side and limits the movement of the portion 42*g*.

As will be apparent from FIG. 4*a*, each spring clamp 42, 43, 44 acts with the tongue portion designated 42*e* in FIG. 4*b* in the direction of the spring contact portion 27*a*. As the spring end clamp portion 42*e* can be pivoted about the bearing 40 in the clockwise direction, it can therefore be moved away from the spring contact portion $\mathbf{27}a_3$ if a line is guided from above through an opening still to be described. The exposed line portion thus comes to rest between the spring contact portion 27*a* and the spring end clamp portion 42*e* and is fixed by the spring end clamp portion 42*e* in such a way that it is locked or clamped against being pulled out in the direction of the upper side of the housing.

As will be apparent from the foregoing description, each spring contact 27 defines a doubly sprung contact, namely, on the one hand, in the region of the spring joint on the bearing device 28*a*, 28*b*, 28*c*, and on the other hand, by the bent portion $27a_5$, which acts in a resilient manner, when the spring end $27a_7$ comes to rest on the spring contact portion $27a_1$.

As can be seen from FIG. 4*a*, a through-opening 45, through which a line end is guided with its exposed end, is located above each receiving chamber 37*a*, 37*b*, 37*c*, in order to pivot the clamp portion 42*e* in clockwise direction as described after impinging on the spring clamp 42 in the region of the portions 42*e* and 42*f*, allowing the insertion of the exposed line end up to a desired depth and in parallel with the spring contact portion 27*a*. Apart from the through-opening 45, a through-opening 46, which is independent thereof, is formed, which allows access to the clamp portion 42*g* by means of a screwdriver or a similar tool with the aim of pivoting the clamp portion 42*f* in the counterwise direction to release a line end from engagement between the spring contact portion $27a_3$ and the spring clamp end portion 42*e*.

The present statements show that the connection module according to the invention thus allows screwless fastening of line ends, which are inserted in a simple and rapid manner through the respective through-opening 45 into the receiving chamber 37*a* or 37*b* or 37*c* and are fixed automatically by the action between the spring contact 27*a* etc. and spring clamp 42*a* etc., and are secured against being pushed out. However, the line ends can be released again in a simple and rapid manner, in that the spring clamp 42*a* etc. is actuated in the manner described above by means of a screwdriver or another suitable tool, to release the cable ends. Although, in the above-described embodiment, the through-openings 45 and 46 are directed substantially vertically, these may also be inclined or provided in another manner in order to allow line ends to be pushed in or pulled out, even in a direction which is different from the vertical direction.

The number of clamping devices for the connection lines is oriented in the embodiment shown toward two line connections, i.e. for a connection module with three poles. The number of poles can be increased or reduced as required. The number of clamping devices is to be increased or reduced accordingly.

It is important for the fastening and clamping devices for the connection terminals to be provided side by side in a respective plane, thus ensuring an extraordinarily narrow configuration of the connection module. The screwless connection module according to the invention therefore ensures secure, vibration-resistant and gas-tight conductor clamping of the connection line. The above-described courses of the walls and webs also ensure the necessary length between poles, so creepage and air paths can be adapted to necessary desired requirements.

For this purpose, a wall portion 47 emanates obliquely upwards from the wall 29 shown in FIG. 4*a*, so the walls 47 and 29 produce an approximately triangular shape and therefore comparatively large spacing between the introduction portion 45 for the connection line and the spring contact 26*a* below the wall 29*b*.

In the embodiment shown, a latching element 48 is also provided (FIG. 4*a*), which is biased in the anti-clockwise direction by an angled foot. This ensures that, once the connection module has been applied to the busbar system, there is a secure fit relative to the busbar system. The portions 49 and 50 thus generate a spring action. In particular, reference is made to FIG. 4*a*.

As will be apparent from the drawing, the receiving chambers 37*a*, 37*b*, 37*c* are provided with laterally projecting supports forming the foot portions, which engage under the busbars when applied to the busbar system, as is known per se. These combifeet or supports are designated 53, 54, 55 in FIG. 4*a*.

The side wall 24 shown in FIG. 5 is preferably provided releasably relative to the side wall 25 to fasten the side wall 24 to the side wall 25. Latching means 58, 59, 60 projecting from the side wall 25, preferably in the region of the second receiving chambers 37*a*, 37*b*, 37*c*, are provided which, after application of the side wall 24, engage in corresponding openings 61, 62, 63 (FIG. 5) of the side wall 24 and hold the side wall 24 with spacing from the side wall 25. The side wall 24 thus comes to rest on the front edges of the walls 29, 47 etc. and of the walls 65, 66, 67 defining front edges of the foot portions (FIG. 4*a*) which, together with the already described wall 32, form the second receiving chamber with an approximately rectangular shape in the embodiment shown.

In the embodiment shown, the webs or walls 29, 29*a*, 32, 65, 66, 67 etc. are preferably moulded on the wall 25 and are produced therewith in one operation. After introduction of the spring contacts and spring clamps, the wall 24 can finally be applied. As will be apparent from FIG. 4 and FIG. 5 with the exception of the passages 45, 46, a separation is provided between the upper side and the underside of the connection module, for which purpose transverse wall sections 70, 71, 72 extending in the axial direction of the connection module are provided.

The lines or line ends inserted in the connection module according to the invention are preferably guided out laterally from the connection module. To close the connection module according to the invention, a preferably pivotal lid is provided thereon, which is briefly described with reference to FIGS. 6*a* and 6*b*. The closing lid has a substantially U-shaped form with a transverse leg 22*a* and two lateral short legs 22*b*, 22*c* leading from the transverse leg 22*a*. To receive the closing lid 22, arcuate recesses 75, 76 are formed, for example, in the two mutually parallel walls 24, 25, which recesses can be brought into engagement with, for example, pin-like projections 78, 79 on the lid 22 in that these pin-like projections 78, 99 can be "snapped into" the semicircular recesses 75, 76. It is therefore possible to keep the lid 22 pivotally mounted on one side, whereas, on the other side, it can be removed at the same time. The lid 22 is thus pivotally held, according to FIG. 6*b*, on the connection module, when it is released relative to the latching openings on the opposing side. Instead of semicircular recesses 75, 76, corresponding slots can be provided to allow a degree of displaceability of the pin-shaped bearing devices 78, 79.

As will be apparent from FIGS. 6*a* and 6*b*, the cover plates 22 are formed by pin-shaped joints 78, 79, which can be latched in corresponding joint openings 75, 76 in the two side walls 24, 25. These pin-shaped joints 78, 79 extend perpendicularly to the axis of the cover plate 22 in this embodiment.

The invention claimed is:

1. A busbar connection module comprising:

a housing, said housing comprising a first group of receiving chambers for spring contacts, which are arranged side by side in a plane, the receiving chambers of the first group being defined by walls, which are molded onto at least one of a plurality of side wall of the housing;

a predetermined number of clamping devices arranged in the housing for receiving and fastening stripped line ends, said clamping devices being arranged next to one another in a plane and being constructed without screws, supports projecting on the underside of the clamping devices for fastening to power supply bars; and a second group of receiving chambers, each of said chambers being provided adjacent to a respective receiving chamber of the first group for receiving one of the clamping devices, each clamping device comprising a contact spring and a clamping spring, said contact spring being provided for being contacted by an associated power supply bar, and wherein further a clamp portion of said clamping spring is connected with a portion of said contact spring, wherein the receiving chambers of the first and second groups are divided by a partition which establishes a slot, through which a leg of the respective spring contact is guided.

2. The busbar connection module according to claim 1, wherein each clamping device is formed by a spring clamp.

3. The busbar connection module according to claim 1, wherein each spring clamping device has a slotted spring tongue or a spring tongue with an opening, in which a portion of the respective spring contact and an adjustable tongue of the spring clamp engage.

4. The busbar connection module according claim 1, wherein each receiving chamber of the first group comprises a mounting device holding the associated spring contacts in the first receiving chamber.

5. The busbar connection module according to claim 1, wherein each receiving chamber of the second group of receiving chambers comprises a mounting device for each associated clamping device.

6. The busbar connection module according to claim 1, wherein each receiving chamber comprises a substantially horizontally extending support wall for supporting a clamp portion of the respective clamping device.

7. The busbar connection module according claim 1, said each receiving chamber of the second group of receiving chambers comprising a laterally terminating side wall which at least partially surrounds the respective clamping device.

8. The busbar connection module according to claim 1, said housing further comprising an opening being arranged between each spring contact and the associated clamping device to guide through a line end in the direction of a movable spring tongue of the associated clamping device.

9. The busbar connection module according claim 1, wherein said housing further comprises an opening which is provided to guide through a tool such as a screwdriver in the direction of the clamping device to pivot a clamp portion of the respective clamping device to release a line connection end.

10. The busbar connection module according to claim 1, wherein said housing is provided with a latching means for fastening a side wall which can be applied to the housing.

11. A busbar connection module comprising:

a housing, said housing comprising a first group of receiving chambers for spring contacts, which are arranged side by side in a plane, wherein said receiving chambers are fixed by walls, which are molded onto at least one of a plurality of side walls of the housing;

a predetermined number of clamping devices arranged in the housing for receiving and fastening stripped line ends, and comprising feet projecting on the underside of the clamping devices for fastening to power supply bars, said clamping devices being arranged next to one another in a plane and being constructed without screws; and a second group of receiving chambers, which are provided adjacent to each of the first receiving chambers, for receiving a clamping device, wherein said housing is provided with a latching means for fastening a side wall, wherein said side wall comprises latching openings associated with further latching means arranged in said housing, wherein the receiving chambers of the first and second groups are divided by a partition which establishes a slot, through which a leg of the respective spring contact is guided.

12. The busbar connection module according to claim 11, wherein said further latching means are formed in the second receiving chamber.

13. A busbar connection module comprising:

a housing, said housing comprising a first group of receiving chambers for spring contacts, which are arranged side by side in a plane, said receiving chambers being defined by walls, which are molded onto at least one of a plurality of side walls of the housing;

a predetermined number of clamping devices arranged in the housing for receiving and fastening stripped line ends, said clamping devices being arranged next to one another in a plane, being constructed without screws, and further comprising supports projecting on the underside of the clamping devices for fastening to power supply bars; and a second group of receiving chambers, which are provided adjacent to each of the receiving chambers of the first group of receiving chambers, for receiving one of the clamping devices, wherein said housing comprises parallel side walls, said side walls having openings, and a cover plate, and wherein said cover plate is provided with joints, which can be latched into the openings of the side walls, wherein the receiving chambers of the first and second groups are divided by a partition which establishes a slot, through which a leg of the respective spring contact is guided.

14. A busbar connection module comprising:

a housing, said housing comprising a first group of receiving chambers for spring contacts, which are arranged side by side in a plane, wherein the first receiving chambers are fixed by walls, which are molded or sprayed onto at least one of a plurality of side walls of the housing, a predetermined number of clamping devices arranged in the housing for receiving and fastening stripped line ends, comprising feet projecting on the underside of the clamping devices for fastening to power supply bars, said clamping devices being arranged side by side in a plane and being constructed without screws, and a second group of receiving chambers, which are provided adjacent to each of the first receiving chambers for receiving one of the clamping devices, wherein said housing comprises parallel side walls, said side walls having openings, and a cover plate, wherein said cover plate is provided with joints, which are latched into a corresponding opening of the side walls, wherein the joints formed on the cover plate are formed in the shape of pins and extend perpendicularly to the axis of the cover plate, and wherein the receiving chambers of the first and second groups are divided by a partition which establishes a slot, through which a leg of the respective spring contact is guided.

* * * * *